United States Patent [19]

Richardson

[11] Patent Number: 4,855,884

[45] Date of Patent: Aug. 8, 1989

[54] VARIABLE BEAMWIDTH STAGE LIGHT

[75] Inventor: Brian E. Richardson, San Jose, Calif.

[73] Assignee: Morpheus Lights, Inc., San Jose, Calif.

[21] Appl. No.: 127,932

[22] Filed: Dec. 2, 1987

[51] Int. Cl.[4] ..... F21V 7/00

[52] U.S. Cl. ..... 362/278; 362/286; 362/289; 362/346; 362/320

[58] Field of Search ..... 362/277, 278, 288, 286, 362/289, 303, 306, 346, 347, 358, 319, 320, 323, 324, 280, 281, 296, 297, 187

[56] References Cited

U.S. PATENT DOCUMENTS

| | | | |
|---|---|---|---|
| 2,976,511 | 3/1961 | Lipsitz | 339/33 |
| 3,075,070 | 1/1963 | Lipsitz | 240/1.3 |
| 3,609,337 | 9/1971 | Adra et al. | 362/306 |
| 3,827,782 | 8/1974 | Boudouris et al. | 350/295 |
| 3,839,632 | 10/1974 | Federico | 362/278 |
| 3,953,726 | 4/1976 | Scarritt, Sr. | 362/286 |
| 4,338,655 | 7/1982 | Gulliksen et al. | 362/347 |
| 4,398,238 | 8/1983 | Nelson | 362/187 |
| 4,602,321 | 7/1986 | Bornhorst | 362/268 |

FOREIGN PATENT DOCUMENTS

| | | | |
|---|---|---|---|
| 2826867 | 1/1979 | Fed. Rep. of Germany | 362/346 |
| 648132 | 12/1928 | France | 362/277 |
| 0596776 | 3/1978 | U.S.S.R. | 362/346 |

*Primary Examiner*—Ira S. Lazarus
*Assistant Examiner*—D. M. Cox
*Attorney, Agent, or Firm*—Rosenblum, Parish & Bacigalupi

[57] ABSTRACT

A variable beamwidth stage light relying upon an axially movable reflector for changes in beamwidth. The reflector has a plurality of radially outwardly and axially forwardly extending leaves in side-by-side relation to define a bowl-shaped reflector surface. A stationary support flange is in frictional contact with the radially outward surface of each leaf. The reflector leaves are sandwiched between a base member and a ring member at the base of the reflector. A motor driven lead screw is attached to the base member to cause axial movement of the reflector relative to the support flange. The reflector defines a first and a second focal point along the axis of the reflector. A light source is fixed at the first focal point, which remains substantially fixed relative to the base member. Contact of the support flange with the reflector leaves causes the diameter of the reflector leaves to vary as the base member is moved, thereby causing displacement of the second focal point and variation of the bandwidth issuing from the reflector.

21 Claims, 2 Drawing Sheets

VARIABLE BEAMWIDTH STAGE LIGHT

DESCRIPTION

1. Technical Field

The present invention relates generally to stage lights.

2. Background Art

Modular stage lighting systems for concert tours have become increasingly common. Such systems are utilized to enhance performances and often include a number of individual stage lights which are gimbaled to pan and to tilt. Besides panning and tilting other stage light features include a fader shutter, a color scroll and a diffusion filter. All of these features may be remotely controlled to afford almost instantaneous variations in the characteristics of a beam of light issuing from an individual stage light.

However, while various features of individual stage lights in a modular system may be altered during the course of a performance, the beamwidth is normally a constant. Typically, a stage light contains a lamp fixed within the interior of a reflector. The reflector directs the energy toward a desired location. To change the beamwidth it is necessary to change the light source which radiates the light energy.

U.S. Pat. No. 4,602,321 to Bornhorst teaches a method of adjusting beam spread. Bornhorst teaches that a light source can be caused to move rearwardly and forwardly within a reflector. In moving the light source, the light filament approachs or withdraws from the focal point of the reflector. Thus, there is only one position at which the filament is at the focal point of the reflector. It follows that in addition to varying the beamwidth from the stage light, movement of the light source significantly affects the intensity of the beam. The intensity varies across the range of light source movement, being most intense when the light filament is at the focal point of the reflector to collimate the light rays. Moreover, even when the light source is stationary, there are variations in intensity since, at times when light is not collimated, intensity varies across the width of the beam. The variations in intensity may not be detrimental in all applications, but are undesirable in certain applications.

U.S. Pat. No. 4,338,655 to Gulliksen et al. describes a luminaire having a plurality of expansible reflector members which are moved within channels to modify a focused spot configuration of light to provide a flood configuration. Rotation of a light transmitting member changes the focal point of the apparatus.

U.S. Pat. Nos. 4,398,238 to Nelson, 3,827,782 to Boudouris et al. and 3,839,632 to Federico likewise disclose means for affecting beamwidth by moving a light source relative to a focal point. Nelson teaches a variable focus flashlight in which the head of the flashlight is rotated to move a reflector relative to a bulb. Once the flashlight beam is focused, a spring provides a bias to retain the flashlight head in the desired rotational position. Boudouris and Federico each teach that a bowl-shaped reflector may be bent to change the focal point of a light, thereby displacing the focal point of the reflector. These prior art references teach reflectors having a solid construction, although Federico teaches that the reflector may have slits along a minor portion of reflector. A solid construction or a plurality of minor slits prevents significant light loss through the reflectors, but bending of the reflectors will result in a reflector which is not axisymmetrically curved.

It is an object of the present invention to provide a stage light which allows control of beamwidth and which retains an axially symmetric beam during adjustment of the beamwidth. It is a further object to provide such a stage light in which the filament of the light source remains at a focal point of the reflector during variation of the beamwidth and aids in creating a relatively constant field of intensity across the beamwidth issuing from the stage light.

SUMMARY OF THE INVENTION

The above objects have been met by a stage light having a reflector surface comprised of a plurality of leaves which independently pivot or bend and which are mounted in side-by-side relation. The leaves are preferably, but not critically, joined at one end to form a base of a concave reflector that is shaped by the identical bending of the leaves. The concave reflector has a generally bowl-shaped configuration and defines a first focal point. A lamp is fixed at the base of the reflector and the focal point of the reflector is fixed at a point along the longitudinal filament of the lamp.

The stage light includes a box frame having an open face for the passage of light. The reflector is positioned to be concave relative to the open face. The leaves of the reflector project axially forwardly and radially outwardly from the base to a peripheral edge of the reflector. At the reflector base the leaves are supported in position by a ring member and a base member which sandwich the leaves. Axially outward from the base, the exterior surface of each leaf is supported by a stationary support flange having an aperture into which the reflector is seated. A motor driven lead screw engages the base member and as the lead screw is rotated the base member will move to create axial displacement of the reflector and the lamp. As the reflector is axially displaced, the stationary support flange will bend or relax the individual leaves, depending upon the direction of displacement.

The reflector leaves create an elliptical beam system having an axially inward first focus fixed at the filament of the lamp and having an axially outward second focus which is varied between positions by bending or relaxing the reflector leaves. The beamwidth of the stage light is dependent upon the distance between the axially outward focus and the object upon which the beam lands. A feedback circuit provides precise positioning of the reflector.

A shield mounted within the reflector perpendicular to the reflector axis and in alignment with the lamp prevents excess spillage of light from the stage light. The shield blocks the light which would otherwise cause a halo effect around the edges of a spotlight pattern.

An advantage of the present invention is that the reflector surface is formed of leaves which are individually bendable so that accidental deformation of one leaf does not interfere with adjacent leaves and so that the beam shape is not noticeably impaired. Also, individual leaves allow the formation of a desired reflector shape which can easily be modified by bending the leaves into another shape of the same family. This cannot be done with a single piece reflector wherein bending usually causes loss of the desired family shape. Another advantage is that the reflector will propagate a uniform beam throughout the range of reflector motion. Thus, while some variation of light intensity will occur during movement of the reflector through the range, the intensity variation will not be detrimental because it is generally uniform at each position of the reflector. A third important advantage is that the bending of the elliptical reflector permits refocusing of the reflected light beam to reproduce a real image from a distance as close as two feet to an infinite distance. The ability to refocus the reflected image allows the stage light to illuminate all or part of a stage with a beam having a relatively constant field of light intensity.

BEST MODE FOR CARRYING OUT THE INVENTION

Figure 1:
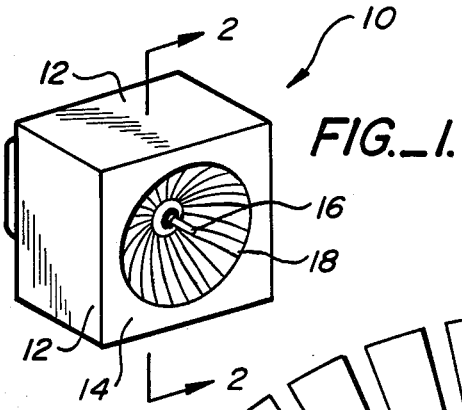
FIG. 1 is a perspective view of a stage light in accord with the present invention.

With reference to FIG. 1, a stage light 10 is shown having side walls 12 and a face plate 14 having an aperture for the transmission of light. A lamp 16 mounted at the center of a reflector 18 propagates light rays for illumination of a stage. Typically, a plurality of stage lights 10 are suspended from a truss by a gimbal. The stage lights may then be controlled separately or as a unit to tilt or to pan. Optionally, a stage light 10 includes a color scroll (not shown) extended across the front of the reflector, with the color scroll being attached to a remotely controlled motor that rotates the scroll to vary the color of the beam issuing from the stage light.

Figure 2A:
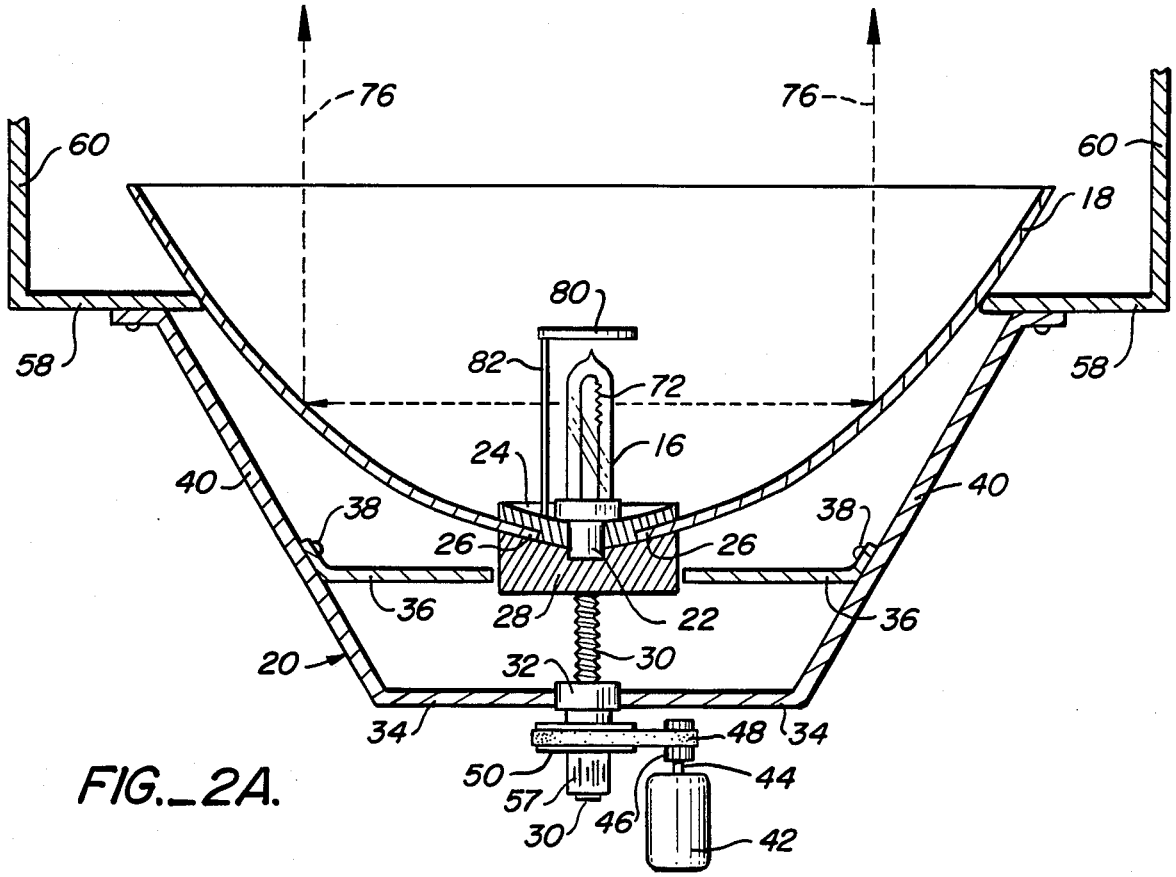
FIGS. 2 and 2A are side sectional views of the light propagating assembly of FIG. 1.
Figure 2:
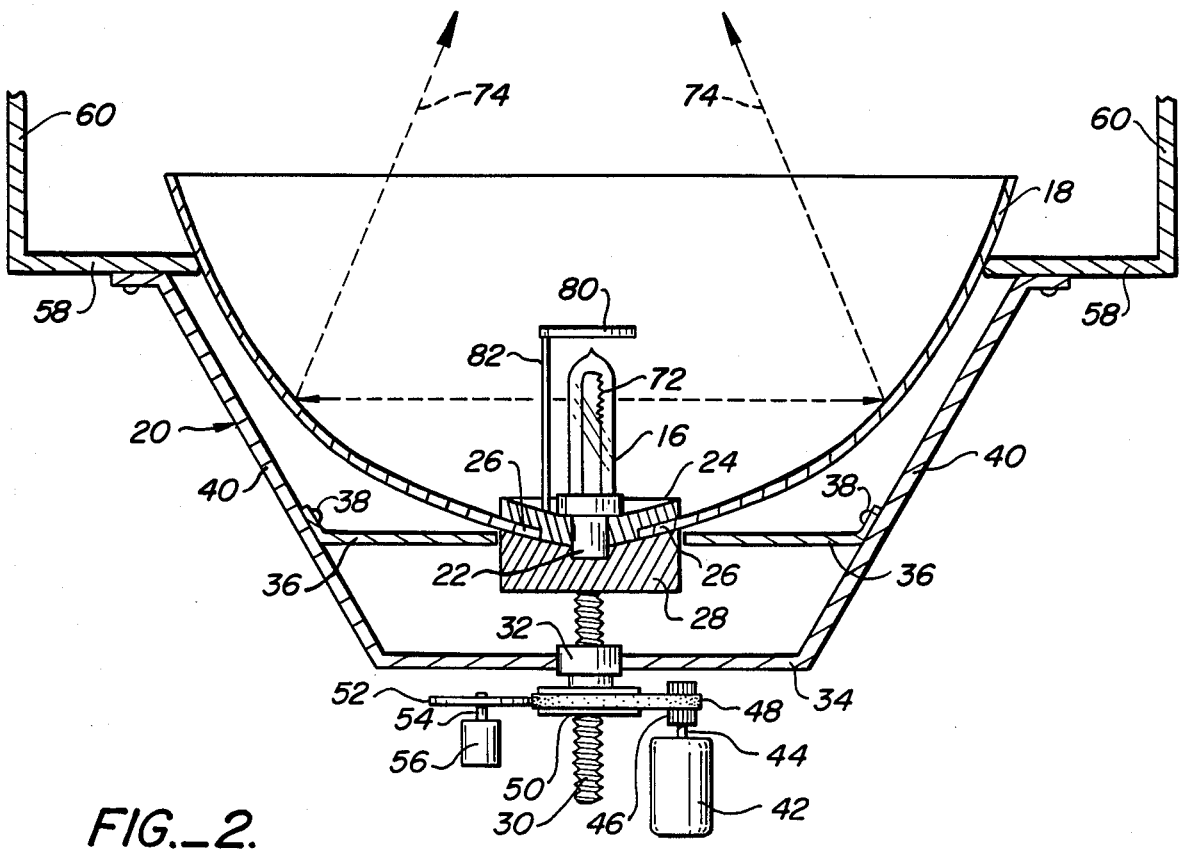

Referring now to FIGS. 2 and 2A, the light propagating assembly of the stage light includes the lamp 16 and the reflector 18 which are positioned by a support structure 20. The lamp 16 is inserted into a lamp socket 22 within a ring member 24. The ring member 24 rests atop the radially inward edge 26 of the reflector 18. In turn, the radially inward edge 26 is in frictional contact with a base member 28. The ring member 24 and base member 28 are secured together to sandwich the edge 26 of the reflector.

The base member 28 is internally threaded at its center to mesh with the external threads of a lead screw 30. A securing bearing 32 is fixedly attached to a crossmember 34 of the support structure 20 and is in engagement with the lead screw 30. Thus, rotation of lead screw 30 will create movement of the base member 28 relative to the crossmember 34. A crossbrace 36 is fastened by screws 38 to opposed diverging legs 40 of the support structure 20, but the crossbrace 36 has a center orifice that permits the base member 28 to move freely.

As viewed from the rear of the light propagation assembly of FIGS. 2 and 2A, clockwise rotation of the lead screw 30 causes forward movement of the base member 28, while counterclockwise rotation results in rearward movement of the base member. Lead screw rotation is provided by a motor 42. The motor 42 may be a D.C. motor or a stepper motor. A motor shaft 44 is connected to a gear 46 which tensions an endless belt 48 having radially inward teeth, not shown, in meshing engagement with the teeth of the motor gear 46. The endless belt wraps about a pulley 50 contacting the lead screw 30. In this manner rotary motion supplied by the motor 42 is translated to the lead screw 30 for movement of the base member 28. The circumference of the endless belt 48 is in frictional contact with a circular plate 52. An arm 54 of a potentiometer 56 is fixed at the center of the circular plate 52 for rotation therewith. Thus, the potentiometer 56 may be used to sense rotation of the lead screw 30. The potentiometer is connected across a 15 V DC supply. The potentiometer is part of a feedback circuit which measures the voltage drop across the potentiometer to determine the precise position of the base member 28 relative to a fixed point. Alternatively, the potentiometer may be replaced by an encoder 57, as shown in FIG. 2A.

The diverging legs 40 of the support structure 20 are fastened to a support flange 58 cylindrical member 60. The support flange 58 has a central aperture into which the reflector 18 is seated. The exterior surface of the reflector 18 rests upon the support flange 58 so that the diameter of the reflector along the plane defined by the support flange is equal to the diameter of the central aperture. The ring member 24 and the base member 28 sandwich the radially inward edge 26 of the reflector 18 so that as the base member is caused to be moved by rotation of lead screw 30, the reflector is axially displaced. Displacement of the reflector 18 results in a modification of the reflector curvature and the width of the beam issuing from the reflector is therefore affected.

Figure 3:
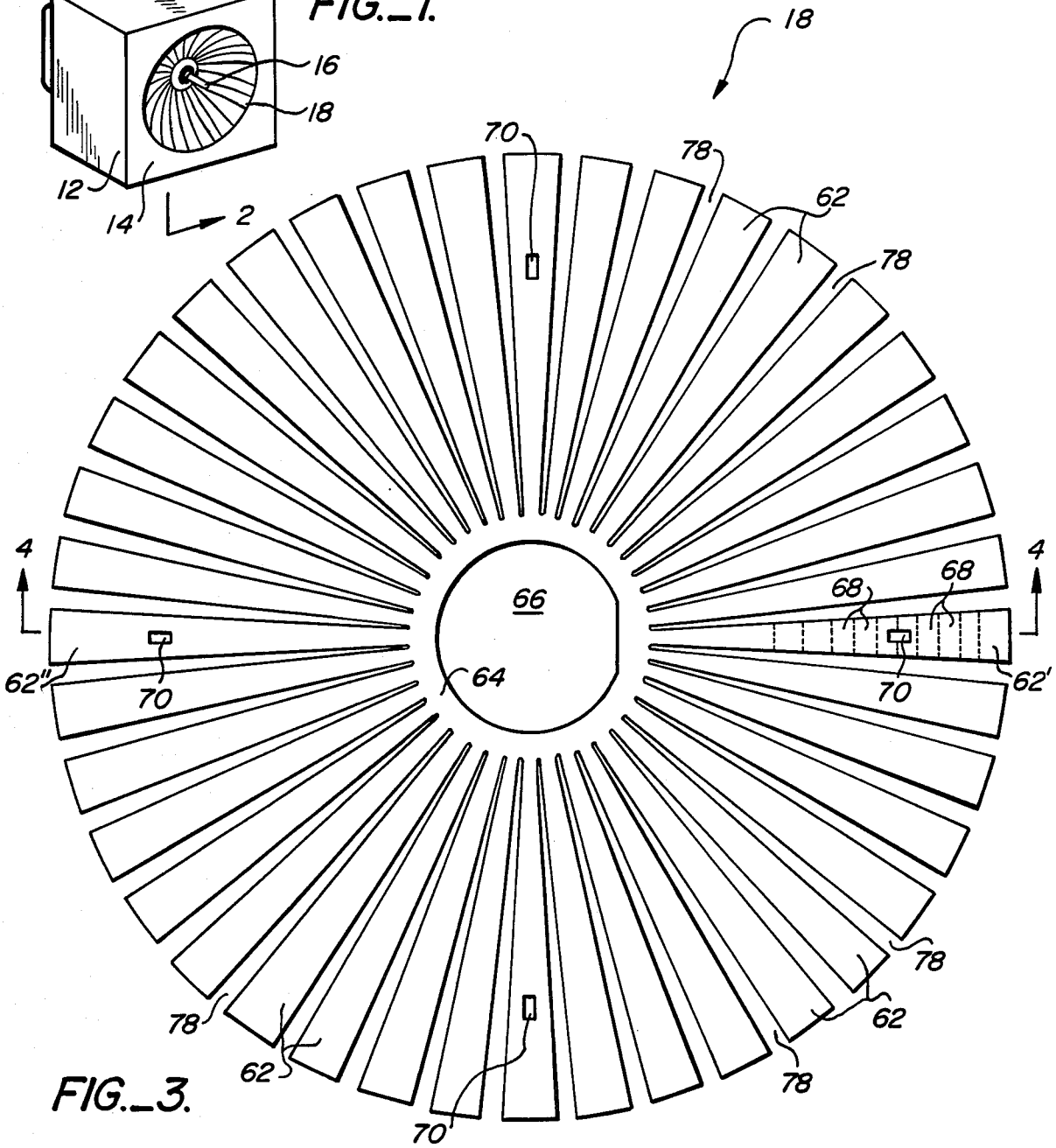
FIG. 3 is a top view of the reflector in the light of FIG.
Figure 4:
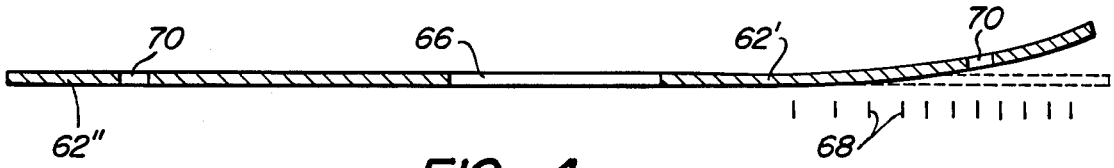
FIG. 4 is a side sectional view of a reflector leaf of FIG. 3, taken along line 4—4.

Turning now to FIGS. 3 and 4, the reflector 18 is made up of forty leaves 62. The leaves 62 are joined at a center unbroken region 64. The leaves are spaced apart equidistantly from each other at an angle of 9°. A central aperture 66 permits passage of part of the ring member 24 to the base member 28, as shown in FIG. 2. Each leaf 62 is made of a reflective and resilient material, such as aluminum alloy and has a preferably uniform thickness of approximately 0.016 inches. The width of each leaf 62 tapers in a radially inward direction. The reflector 18 has a diameter of approximately eleven inches.

FIG. 4 shows a pair of leaves 62' and 62''. The leaves, as initially manufactured, are planar. Each leaf 62' is then bent at eleven positions to produce leaf increments 68 that are each bent at 1.5°. The bowed increments 68 along with the 17.5° arch of the ring member 24 seen in FIG. 2, partially define the optimal shape of the reflector which can then reflect a beam of uniform intensity.

At least two pairs of opposed leaves 62 have radially elongated alignment apertures 70 disposed to receive alignment tabs projecting from the support flange to act as guides during reflector movement.

In operation, FIGS. 2 and 2A show that the lamp 16 includes a longitudinal coiled filament 72 which extends parallel to the axis of the elliptical reflector 18. The reflector 18 is an "elliptical" reflector since it generates a beam pattern having a first focus (F1) proximate the ring member 2A, and having a second focus (F2) outward of F1 along the axis of the reflector. Preferably, the axially inward focal point (F1) is 1.75 inches from the base of the reflector leaves 62. This dimension is constant and is partially defined by the 17.5° arc of the ring member 24. The second focal point (F2) is not constant, but rather is determined by the bend of the reflector leaves 62 provided at the support flange 58. Restricted to the 2-dimensional drawings of FIGS. 2 and 2A, relaxation of the reflector 18 will widen the ellipse associated with F1 and F2 and, since F1 is fixed relative to the reflector, will cause F2 to be displaced axially outward of the original locus of F2. Thus, for an object positioned at a fixed distance from a stage light, e.g., 10 feet, the beamwidth of the stage light as it strikes the object may be varied by displacement of F2 relative to F1. For example, if F2 is brought to within a distance of two feet from the base of reflector 18, a floodlight will be produced as the individual light rays diverge after intersection at F2. In comparison, if F2 is located at a distance one foot from an object, a spotlight is created as the beam strikes the object.

The second focal point (F2) may be brought to within as close as two feet or may be located an almost infinite distance from the reflector 18. The motor 42 drives the endless belt 48 to rotate the lead screw 30. Rotation of the lead screw results in axial movement of the base member 28 which engages the lead screw 30. The potentiometer 56 is in rotation transfer relation with the endless belt 48 and registers the position of the base member 28, and therefore the reflector 18, by the change in voltage drop across the potentiometer. Positioning of the reflector may be precisely performed by reading the voltage drop for utilization as location feedback. Alternatively the potentiometer maya be replaced by an encoder 57, as shown in FIG. 2A, or by some other sensor means known in the art.

FIG. 2 illustrates the reflector 18 in an extreme bent position. Light rays 74 will intersect at a focal point F2, not shown, proximate the reflector 18 and will thereafter diverge, forming an ever-widening beam as the light rays 74 progress beyond F2.

FIG. 2A illustrates the reflector 18 in the more relaxed condition. Axial movement of the base member 28 translates into movement of the reflector relative to the support flange 58. Consequently, the peripheral edge of the reflector 18 increases in diameter as the reflector is moved forwardly, thereby increasing the width of the ellipse associated with the resulting focal points F1 and F2. The relaxed condition of FIG. 2A emits light rays 76 which provide more of a spotlight pattern for objects at a distance from the reflector 18. However, the beam retains a relatively uniform intensity across the beamwidth. The uniform intensity is the result of a number of factors. First, the light source 16 remains at the focal point (F1) during bending and relaxation of the reflector 18. This is distinguished from changing the position of the light source relative to the focal point of a reflector so as to change the light rays of a beam from a collimated condition to one in which the light rays are converging or diverging. Maintenance of the light source 16 at the focal point of the reflector 18 is insured by the inclusion of the axially extending light filament 72.

Uniformity of field intensity is further promoted by the use of a plurality of resilient leaves 62 to construct the reflective surface, as shown in FIG. 3. The leaves 62 are placed in side-by-side relation and are originally spaced apart by gaps 78. Accidental bending of one leaf 62 does not affect adjacent leaves and, as a result, undesirable distortions of the reflector 18 are minimized. Each leaf 62 is normally identically curved to reflect light rays identically.

A shield 80 is suspended at the end of a rod 82 to block the lamp 16. The shield 80 is in alignment with the lamp 16 to prevent excess spillage of light which would cause a halo effect around the edge of a spotlight pattern. The rod 82 is rotatably fixed to the ring member 24 so that the shield 80 may be pivoted during replacement of the lamp 16.

The present invention has been explained as having a metal support flange 58. It is understood, however, that the means for defining the diameter of the elliptical reflector 18 at a particular plane may be a ring or some other structure which remains stationary during movement of the reflector.

What is claimed:

1. A variable beamwidth light comprising, a bowl-shaped reflector including a plurality of elongated leaves made of an elastically deformable material and having inward portions disposed adjacently to form a base which defines a central aperture and from which said leaves radiate outwardly and forwardly along the center axis of said aperture to respective outward ends collectively defining a peripheral edge of said reflector, said leaves being bent at multiple predetermined incremental positions and forming substantially the entirety of the reflector, a light source fixed relative to said base and axially aligned with said central aperture, a fixed flange defining a shaping aperture having a diameter less than twice the length of said leaves through which said reflector is movably disposed said leaves extending through said shaping aperture and being constrained to assume an elliptical shape by engagement with said flange, and means for displacing, relative to said fixed flange, said reflector and said light source along said axis to cause said reflector to be elastically deformed at said incremental positions to curve through shapes belonging to a selected common family of ellipses as said reflector is moved axially relative to said flange means, to selectively vary the ellipticity of said reflector and thus vary the width of a light beam reflected from the reflector.

2. The light of claim 1 wherein said leaves define simultaneously a first and a second focal point positioned along said axis, said first focal point being located axially inward of said second focal point, and said second focal point being located at a position determined by the axial displacement of said reflector and said light source relative to said fixed flange.

3. The light of claim 1 further comprising a shield mounted within said reflector perpendicular to, and pivotable between positions out of and in alignment with, said axis.

4. The light of claim 1 wherein leaves in at least one radially opposed pair of leaves each includes an alignment aperture, and said fixed flange includes alignment tabs disposed to be received by said alignment apertures, said alignment apertures being elongated along the length of said leaves to permit axial movement of the reflector.

5. The light of claim 1 wherein said means for displacing the reflector and said light source comprises a motor linked to a lead screw to rotate said lead screw, said lead screw having external threads in motion transfer engagement with said reflector, and further comprising a feedback circuit linked to said motor to precisely position said reflector relative to said fixed flange.

6. The light of claim 5 wherein said feedback circuit includes a potentiometer in rotation transfer engagement with said lead screw.

7. The light of claim 5 wherein said feedback circuit includes an encoder.

8. A variable beamwidth light comprising, a plurality of leaves axially symmetrically arranged in side-by-side relation to form an elliptically-shaped reflector having a base which defines a central aperture and having a first focal point, each of said leaves being made of a resilient material and having an interior surface and an exterior surface, flange means fixedly disposed and having a shaping aperture for receiving and frictionally contacting the exterior surfaces of the leaves for defining the ellipticity of said reflector and thereby prescribing the reflector focal length to a second focal point axially outward of said first focal point, a light source mounted fixedly with respect to said central aperture so as to radiate light from said first focal point, drive means for repositioning said light source and the base of the reflector together relative to said fixedly disposed flange means, thereby varying the beamwidth of light reflecting from said reflector, and feedback means for controlling said drive means to precisely position said reflector.

9. The light of claim 8 wherein said leaves are joined in an area closely proximate said central aperture of the base.

10. The light of claim 8 wherein each of said leaves has a width partially defining the shape of the reflector and said width of each leaf has a taper narrowing in the direction of said base.

11. The light of claim 8 wherein leaves in at least a pair of radially opposed leaves each includes a longitudinally extending alignment aperture and said flange means has alignment tabs disposed to be received by said alignment apertures.

12. The light of claim 8 wherein said light source is a lamp having a filament extending longitudinally at least closely along the axis through said first focal point of said reflector.

13. The light of claim 8 wherein said drive means includes a motor driven rotatable lead screw.

14. The light of claim 13 wherein said feedback means includes a potentiometer in rotation transfer engagement with said lead screw for sensing rotation of the lead screw.

15. The light of claim 8 wherein said feedback means includes an encoder.

16. The light of claim 8 further comprising a shield pivotally mounted within said base of the reflector perpendicular to the reflector axis for selective alignment with said axis.

17. The light of claim 8 further comprising a frame structure having solid back and side ends and having an open face front end, said reflector being disposed in said frame structure to reflect light rays through said open face end.

18. A stage light comprising, a frame structure having opposed closed lateral ends, a closed back end, and an open face front end, a plurality of elongated leaves mounted within said frame structure, said leaves being disposed in a radially symmetric pattern extending axially forwardly and outwardly to define a generally bowl-shaped reflector having a focal point defined by the shape of the reflector, said leaves being made of a resilient material and having inward portions joined to form a reflector base defining a central aperture closely proximate said inward portions, said leaves each having an interior surface and an exterior surface and being bent at multiple predetermined incremental positions, mounting means for securing said reflector base, said mounting means including a base member in frictional contact with the exterior surfaces of said leaves and including a ring member in frictional contact with the interior surfaces of said leaves to sandwich said reflector base between said base member and said ring member, a light source affixed to said base member, said light source having a light filament with a longitudinal extension through the focal point, flange means defining the front end of the frame structure and in frictional contact with said exterior surfaces of the leaves for restricting the diameter of the reflector at its points of contact with said flange means, and drive means for axially moving said base member and reflector relative to the flange means to cause said reflector to be elastically deformed at said incremental positions to curve through shapes belonging to a selected common family of ellipses as said reflector is moved axially relative to said flange means, thereby varying the bowl-shaped dimensions of said reflector and causing displacement of said focal point along the longitudinal extension of the light filament.

19. The stage light of claim 18 wherein said leaves each have a width partially defining the shape of the reflector, each said leaf width tapering towards said base.

20. The stage light of claim 18 wherein at least one pair of radially opposed leaves include longitudinally extending alignment apertures, and wherein said flange means includes alignment tabs disposed to be received by said alignment apertures to permit axial movement of the reflector.

21. The stage light of claim 19 wherein said leaves have a uniform thickness between said interior and exterior surfaces.

* * * * *